United States Patent [19]

Hardies

[11] 4,015,165

[45] Mar. 29, 1977

[54] ELECTRIC LAMP WITH MOLYBDENUM CONTACT PINS SURROUNDED BY NON-CORROSIVE METAL SLEEVES

[75] Inventor: Alfons Eugeen Maria Hardies, Eindhoven, Netherlands

[73] Assignee: U.S. Philips Corporation, New York, N.Y.

[22] Filed: Dec. 18, 1975

[21] Appl. No.: 642,078

[30] Foreign Application Priority Data

Apr. 2, 1975 Netherlands ..... 7501272

[52] U.S. Cl. ..... 313/318; 174/50.52; 174/50.64; 313/331

[51] Int. Cl.[2] ..... H01J 5/46; H01J 61/36; H01K 1/40

[58] Field of Search ..... 313/331, 332, 318, 315, 313/222; 174/50.64, 50.52, 50.6, 50.59

[56] References Cited

UNITED STATES PATENTS

| | | | |
|---|---|---|---|
| 2,385,340 | 9/1945 | Baxter | 174/50.6 X |
| 3,465,197 | 9/1969 | Martin | 313/332 X |
| 3,780,328 | 12/1973 | Boddy et al. | 313/222 X |
| 3,818,558 | 6/1974 | Vause | 313/331 X |

*Primary Examiner*—Palmer C. Demeo
*Attorney, Agent, or Firm*—Frank R. Trifari; Robert S. Smith

[57] ABSTRACT

Electric lamps having a quartz glass lamp envelope frequently have outer current conductors of molybdenum because this metal has a coefficient of expansion which corresponds best to that of quartz glass. Because molybdenum is sensitive to oxidation the current conductors quickly oxidize so that a good electric contact with connection terminals of a current source is no longer possible. According to the invention, the outer current conductors are surrounded by a sleeve of non-corrosive metal and are rigidly connected thereto by a local kink in the current conductor and the sleeve.

4 Claims, 2 Drawing Figures

ELECTRIC LAMP WITH MOLYBDENUM CONTACT PINS SURROUNDED BY NON-CORROSIVE METAL SLEEVES

The invention relates to an electric lamp having a quartz glass lamp envelope with pinched seal, a molybdenum foil being incorporated in the pinch, to which foil are connected an inner current conductor and an outer current conductor of molybdenum which serves as a contact pin.

Molybdenum is an oxidation-sensitive material. Therefore, outer current conductors of this material will soon be oxidized so that they no longer make a good electric contact with the connection terminals of a current source.

Nevertheless one is obliged to use molybdenum for the outer current conductors, since said material has a coefficient of expansion which corresponds best to that of quartz glass and the outer current conductors should be locked deeply in the pinch so as to be able to withstand the forces which occur when the lamp is connected to the current source.

The molybdenum current conductors might be provided with a coating of an oxidation-resistant metal, for example, nickel or palladium, platinum, gold or iridium on a substratum of nickel or copper. However, said coatings form alloys with molybdenum, which alloys melt at approximately 1500° C. When making the pinched seal of the lamp envelope, however, the temperature is approximately 1800° C. It is therefore observed when using coated molybdenum current conductors that the electric contact between said current conductors and the molybdenum foil is interrupted upon making the pinched seal as a result of the fact that the coating and the molybdenum of the foil and the current conductors alloy and fuse.

Another drawback of the use of coated molybdenum current conductors is that the production has to be interrupted frequently, because the welding electrodes, after making the connection between the current conductor and the molybdenum foil, stick to the coating.

This cannot be avoided by coating the outer conductors only partially so that the place where the connection to the foil is to be effected remains uncovered, since the partial coating of the current conductors in practice is not readily performable in series production.

It is the object of the invention to provide a simple and efficacious solution to the problem described.

According to the invention, electric lamps of the kind mentioned in the preamble are characterized in that the part of the outer current conductor projecting beyond the lamp envelope is surrounded by a sleeve of a corrosion-resistant metal and is rigidly secured thereto by a local kink in the current conductor and the sleeve.

The sleeve may consist, inter alia, of nickel, platinum, gold, chromium, iridium, ruthenium, nickel-plated iron, chromium-plated iron, electroplated iron, but nickel, nickel-plated metals, nickel alloys, such as manganese nickel and nickel-plated alloys such as nickel-plated brass, are preferred for economic reasons.

The connection of the sleeve to the current conductor by providing them with a local kink has a number of attractive aspects. Due to the deformation of both the current conductor and the sleeve, the sleeve is both fixed and is readily contacted electrically to the current conductor; this without the thickness of the current conductor and the inside diameter of the sleeve being in a critical relationship. As a result of this, in manufacturing the lamp, the sleeve can easily be slid over the current conductor.

Another advantage of this way of connection appears from lamps in which several current conductors project from one pinch. As a result of the kink of the current conductors, their mutual distance can be varied. This is of importance in lamps which are miniaturized in such manner that the current conductors can no longer emanate at a mutual distance which is equal to the distance of standardized connection sleeves.

It is not a necessary result of the kink that a current conductor after the kink extends parallel to the part before the kink. For example, it is also possible to shape the kink so that the parts of the current conductor before and after the kink are in alignment.

The current conductor and the sleeve are preferably kinked near the end present near the pinch, although in cases in which a lamp is placed laterally in a lighting fitting, the kink may also be provided elsewhere.

It is an object of the invention to provide electric lamps with contact pins which, also after a long period of storage, ensure a good contact with connection terminals in that the pins, at least at the area of the contact with the connection terminals, are corrosion-free. It will be obvious that for that purpose, for example, it is not required that the current conductor should be as long as the sleeve.

In lamps which are inserted axially into a lighting fitting, the sleeve is preferably rounded off or bevelled at the end of the contact pin to facilitate entry of the pin into a cooperating socket.

The invention can be applied both to incandescent lamps, for example, halogen incandescent lamps for projection purposes, which are assembled in a cold light mirror by means of a cement which in itself is corrosive for molybdenum, and to discharge lamps. The additional advantage of nickel sleeves in lamps which are assembled in a mirror by means of cement is that the cement does not flow over nickel, which is the case indeed with molybdenum.

The invention will be described in greater detail with reference to the drawing.

Figure 1:
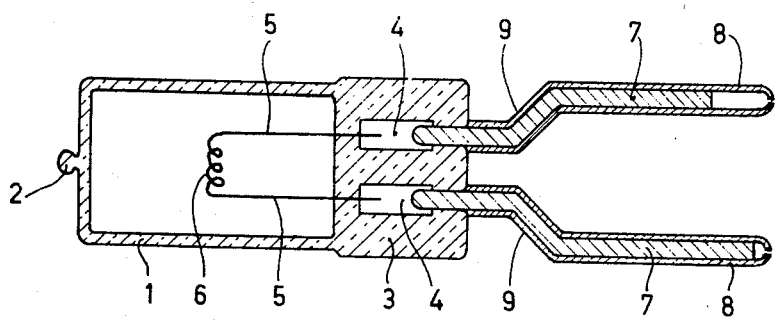
FIG. 1 is a longitudinal cross-sectional view through a mono-pinch incandescent lamp.

In FIG. 1 the quartz glass envelope 1 is sealed at one end by the tipped-off end 2 of the exhaust tube and at the other end by a pinched seal 3. Incorporated in the pinch are molybdenum foils 4 to which inner current conductors 5 are connected which extend to the filament 6. Also connected to the foils 4 are the outer current conductors 7 (0.7 mm thick) which are surrounded by sleeves 8 (inside diameter 0.75 mm, wall thickness 0.125 mm) and form contact pins with them. The current conductors 7 and the sleeves 8 have kinks 9.

Figure 2:
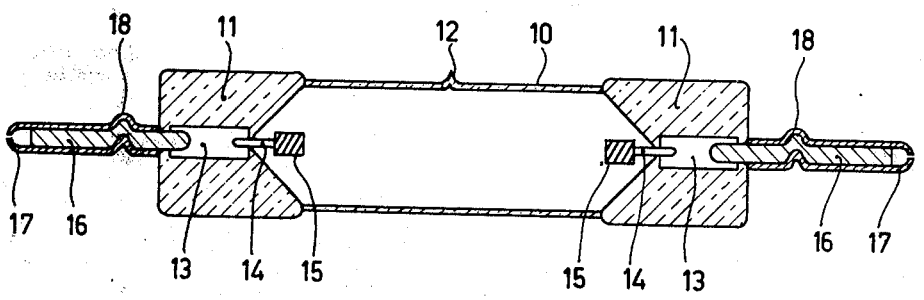
FIG. 2 is a longitudinal cross-sectional view through a discharge lamp.

In FIG. 2 the quartz glass lamp envelope 10 is sealed by the pinched seals 11 and the tipped-off end 12. Incorporated in the pinches are molybdenum foils 13 to which inner current conductors 14 are connected which support the electrodes 15. Connected to the molybdenum foils are outer conductors 16 which are surrounded by sleeves 17. The sleeves and the current conductors have kinks 18.

What is claimed is:

1. An electric lamp having a quartz glass lamp envelope with pinched seal, a molybdenum foil being incorporated in the pinch to which foil are connected an inner current conductor and a contact pin which comprises an outer current conductor of molybdenum, a sleeve disposed about part of the outer current conductor projecting beyond the lamp envelope, said sleeve being a corrosion-resistant metal, said current conductor and said sleeve each having a cooperatively dimensioned and configured kink preventing relative movement therebetween.

2. An electric lamp as claimed in claim 1, wherein said kink is disposed proximate to said pinch.

3. An electric lamp as claimed in claim 1 wherein said lamp has a plurality of current conductors each serving as a contact pin and each disposed in one pinch, the distance between the contact pins at the area where the pins emanate from said pinch being different from that at the end of the pins most remote from said envelope.

4. An electric lamp as claimed in claim 1 wherein the end most remote from said envelope of the sleeve is roundedoff or bevelled.

* * * * *